US005735435A

United States Patent [19]

Kobayashi et al.

[11] Patent Number: 5,735,435

[45] Date of Patent: Apr. 7, 1998

[54] FUEL DISPENSER WITH SEISMIC VIBRATION PERCEPTION FUNCTION.

[75] Inventors: Kenji Kobayashi; Kengo Yamazaki; Hiroyuki Okaniwa, all of Tokyo, Japan

[73] Assignee: Tatsuno Corporation, Tokyo, Japan

[21] Appl. No.: 620,571

[22] Filed: Mar. 22, 1996

[30] Foreign Application Priority Data

Mar. 23, 1995 [JP] Japan ..... 7-090354
Apr. 6, 1995 [JP] Japan ..... 7-106859

[51] Int. Cl.[6] ..... B67D 5/08

[52] U.S. Cl. ..... 222/63

[58] Field of Search ..... 222/1, 5, 52, 63

[56] References Cited

U.S. PATENT DOCUMENTS 4,083,187 4/1978 Nagashima ..... 222/5 X

FOREIGN PATENT DOCUMENTS 60-193894 9/1984 Japan .

*Primary Examiner*—Gregory L. Huson

[57] ABSTRACT

A fuel dispenser with a seismic vibration perception function includes a pump motor, a fuel feeding pump, a flow volume measuring member, a nozzle switch and a fueling control member. The fuel-feeding pump is driven by the pump motor. The flow volume measuring member measures the amount of fed fuel and outputs a flow volume pulse signal. The nozzle switch transmits a nozzle-unhooked signal and a nozzle-hooked signal. The fueling control member causes the pump motor to be "on" and "off" by receiving the nozzle-unhooked and the nozzle-hooked signal respectively and counting the flow volume of fuel by receiving the flow volume pulse signal. The fueling control member contains a seismic vibration perception member for perceiving vibration and transmitting a seismic vibration perception signal for suspending electric supply to the pump motor.

10 Claims, 9 Drawing Sheets

FUEL DISPENSER WITH SEISMIC VIBRATION PERCEPTION FUNCTION.

BACKGROUND OF THE INVENTION

1. Field of the Invention

The present invention relates to fuel dispenser with seismic vibration perception functions, in each of which electric supply to a fueling mechanism or a control apparatus is intercepted when shock is applied by an earthquake or a car crash.

2. Discussion of Background

When an impact caused by an earthquake or a car crash is applied to the fuel dispenser, at a gas station, the electric supply to a fuel dispenser is intercepted with a vibration response switch turned on. In such a situation, a vibration response switch is operated in accordance with vibration, for instance as described in Japanese Laid-Open Patent Application 60-193894, which is connected in parallel to electric supply lines, with the vibration response switch being connected in series to a relay forming a self-held circuit. Thus, the electrical supply to the fuel dispenser can be intercepted.

The electric supply-interception state, which is caused in the case of seismic vibration perception, is maintained by means of the relay circuit. Accordingly, once the electricity is intercepted by a seismic vibration perceived, the relay must be restored to the original state even after the vibration perception by which fueling can be performed without any problems, and this restoration operation is troublesome.

A fuel dispenser contains an electric supply interception unit by which the electricity interception state is maintained with the self-held circuit made "on" by the vibration response switch being operated because of the vibration perception, and the contacts of the relay maintained to be "off". However, when the main electric supply is cut off in this state, the self-held circuit is also made "off", and fueling can be started again by the electrical supply resumed unless the vibration response switch is in the seismic vibration perceived state. Therefore, fueling becomes possible to be carried out without the safety confirmed after electric supply temporarily suspended.

Furthermore, in a conventional fuel dispenser with an electric supply interception unit, it is necessary to maintain a relay therein in the energized state for holding the electric supply interception state. There is also the problem that the relay employed for a self-held circuit loses the self-held function when damaged because of an earthquake or a car crash, and fueling starts again with discharging fuel oil.

SUMMARY OF THE INVENTION

It is therefore an object of the present invention to provide a fuel dispenser with a seismic perception function, by which fueling suspension caused by a small vibration which does not cause any problems on the fuel dispenser can easily be resumed.

Another object of the present invention is to provide a fuel dispenser with a seismic vibration perceptive electric supply interception unit, which maintains the fueling suspension state until a reset switch is operated with the safety confirmed after a seismic vibration is perceived.

A further object of the present invention is to provide a fuel dispenser with a vibration perceptive electric supply interception unit, which can certainly maintain a fueling mechanism in the oil feeding suspension state, even when a relay in the electric supply interception unit is damaged by an earthquake or a car crash.

The first object of the present invention can be attained by a fuel dispenser with a seismic vibration perception function comprising a pump motor, a fuel-feeding pump which is driven by the pump motor, flow volume measuring means for measuring the amount of fed fuel and outputting a flow volume pulse signal, a nozzle switch for transmitting a nozzle-unhooked signal and a nozzle-hooked signal, and fueling control means for causing the pump motor to be "on" and "off" by receiving the nozzle-unhooked signal and the nozzle-hooked signal respectively, and counting the flow volume of fuel by receiving the flow volume pulse signal, the fueling control means comprising seismic vibration perception means for perceiving vibration and transmitting a seismic vibration perception signal for suspending electric supply to the pump motor.

The second object of the present invention can be attained by a fuel dispenser with a seismic vibration perception function comprising a pump motor, a fuel-feeding pump which is driven by means of the pump motor, flow volume measuring means for measuring the amount of fed fuel and outputting a flow volume pulse signal, a nozzle switch for transmitting a nozzle-unhooked signal and a nozzle-hooked signal, a control unit for causing the pump motor to be "on" and "off" by receiving the nozzle-unhooked signal and the nozzle-hooked signal respectively, and counting the flow volume of fuel by receiving the flow volume pulse signal, and a vibration perceptive electric supply interception unit comprising a magnetic memory relay composed of a set coil, reset coil, and first and second magnetic memory contacts which magnetically maintain an "on" state when at least the set coil is excited, an "off" state when only the reset coil is excited, and the "on" state when the set coil and the reset coil are simultaneously de-energized, a vibration response switch by which the contacts are caused to be "off" when vibration is perceived, an electric relay consisting essentially of an operation coil, and first and second electric relay contacts for intercepting electric supply, a reset switch, electric supply lines, and a casing for containing the magnetic memory relay, vibration response switch, electric relay, and reset switch therein, the set coil connected to the first magnetic memory contacts and the vibration response switch in series to prepare a first series circuit, the reset coil connected to the second magnetic memory contacts and the operation coil to prepare a second series circuit, each of the first and second series circuits connected in parallel to the electric supply lines, and the reset switch connected in parallel to the first magnetic memory contacts, thereby electricity to be supplied to the fuel dispenser by way of the electric relay contacts.

The third object of the present invention can be attained by a fuel dispenser with a seismic vibration perception function comprising a pump motor, a fuel-feeding pump which is driven by means of the pump motor, flow volume measuring means for measuring the amount of fed fuel and outputting a flow volume pulse signal, a nozzle switch for transmitting a nozzle-unhooked signal and a nozzle-hooked signal, a control unit for causing the pump motor to be "on" and "off" by receiving the nozzle-unhooked signal and the nozzle-hooked signal respectively, and counting the flow volume of fuel by receiving the flow volume pulse signal, and a vibration perceptive electric supply interception unit comprising a first relay comprising first normally closed contacts IA, first normally opened contacts IB, and second normally opened contacts IC, a second relay comprising first normally opened contacts IIA, second normally opened contacts IIB, and third normally opened contacts IIC, and a vibration response switch by which the contacts are caused to be "off" when vibration is perceived, electricity supplied to the fuel dispenser by way of the second normally opened contacts IC of the first relay and the third normally opened contacts IIC of the second electric relay when the second relay is energized by way of the normally closed contacts IA and the vibration response switch.

The third object of the present invention can also be attained by a fuel dispenser with a seismic vibration perception function comprising a pump motor, a fuel-feeding pump which is driven by means of the pump motor, flow volume measuring means for measuring the amount of fed fuel and outputting a flow volume pulse signal, a nozzle switch for transmitting a nozzle-unhooked signal and a nozzle-hooked signal, a control unit for causing the pump motor to be "on" and "off" by receiving the nozzle-unhooked signal and the nozzle-hooked signal respectively, and counting the flow volume of fuel by receiving the flow volume pulse signal, and a vibration perceptive electric supply interception unit comprising a first relay comprising first normally closed contacts IA, first normally opened contacts IB, and second normally opened contacts IC, a second relay comprising first normally opened contacts IIA, second normally opened contacts IIB, and third normally opened contacts IIC, a vibration response switch by which the contacts are caused to be "off" when vibration is perceived, and electric supply lines, the first relay connected to the electric supply lines by way of the first normally opened contacts IB of the first relay and the first normally opened contacts IIA of the second relay, and the second relay connected to the electric supply lines by way of the normally closed contacts IA and the second normally opened contacts IIB of the second relay with the second relay being connected to the vibration response switch in series, electricity to be supplied to the fuel dispenser by way of the second normally opened contacts IIB of the second relay and the second normally opened contacts IC of the first relay, or the third normally opened contacts IIC of the second relay.

BRIEF EXPLANATION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A fuel dispenser with a seismic vibration perception function of the present invention comprises a pump motor; a fuel-feeding pump which is driven by the pump motor; flow volume measuring means for measuring the amount of fed fuel and outputting a flow volume pulse signal; a nozzle switch for transmitting a nozzle-unhooked signal and a nozzle-hooked signal; and fueling control means for causing the pump motor to be "on" and "off" by receiving the nozzle-unhooked signal and the nozzle-hooked signal respectively, and counting the flow volume of fuel by receiving the flow volume pulse signal, the fueling control means comprising seismic vibration perception means for perceiving vibration and transmitting a seismic vibration perception signal for suspending electric supply to the pump motor.

The present invention will now be explained in detail with referring to accompanied figures.

Figure 1:
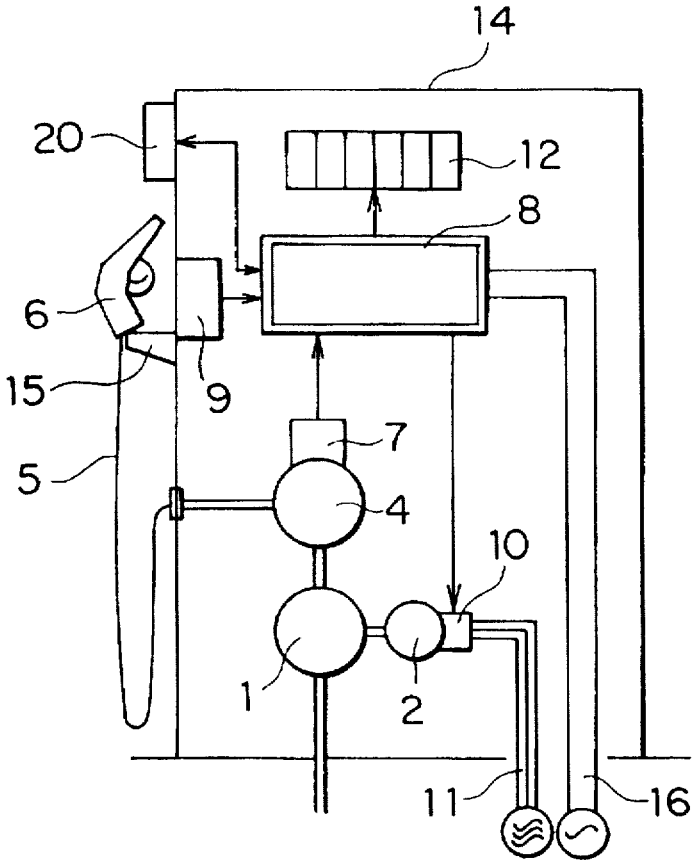
FIG. 1 is a diagram for showing an embodiment of a fuel dispenser of the present invention.

FIG. 1 is a diagram for showing an embodiment of a fuel dispenser of the present invention. In FIG. 1, a reference numeral 1 indicates a fuel-feeding pump driven by means of a pump motor 2, for feeding a fuel oil contained in an underground tank.(not shown) to a fueling nozzle 6 by way of a riser pipe 3.

A reference numeral 4 indicates a flow meter, with a discharge port of the fuel-feeding pump 1 connected to an inlet thereof, and the fueling nozzle 6 connected to an outlet thereof via a hose 5. The amount of oil fed from the nozzle 6 to an automobile fuel tank is output as a flow volume pulse signal from a flow volume pulse signal transmitter 7.

A reference numeral 8 indicates fueling control means which functions as follows:

The fueling control means receives a fueling-requirement signal, that is, a nozzle-unhooked signal. Then, the fueling control means 8 outputs a signal to a motor control switch 10 to supply electricity from a power line 11 to the pump motor 2, and integrate the flow volume pulse signals output while the oil is fed and display the obtained amount of the fed oil on an fed fuel amount indicator 12. Thereafter, the motor control switch 10 is turned off by receiving a fueling suspension signal, that is, a nozzle hooked signal transmitted from the nozzle switch 9, and the electric supply to the pump motor 2 is cut off.

Furthermore, the fueling control means 8 controls the preset-oil feeding, and the succession or suspension in the case where seismic vibration is perceived, by receiving a signal from key-pad 20, which will be explained below, and outputs the information to the key-pad 20 that the fueling is suspended because of seismic vibration perception.

Figure 2:
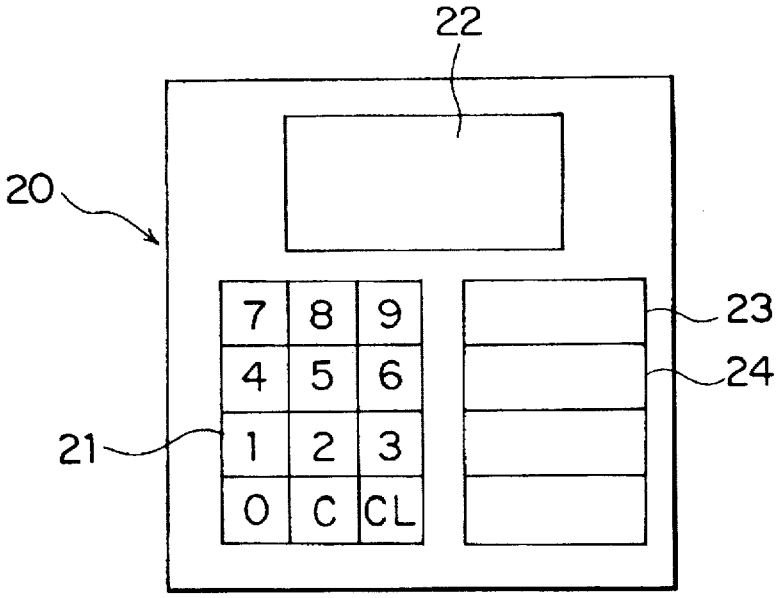
FIG. 2 is a diagram for explaining a key-pad employed for a fuel dispenser of the present invention.

The above-mentioned key-pad 20 is to be provided at a position easily operated. In this embodiment the key-pad 20 is placed nearby a fueling nozzle rest 15 of a casing 14. The key-pad 20 comprises, as shown in FIG. 2, numeric push-button switches 21 for setting information such as an oilpreset amount, an indicator 22 for indicating information from the control means 8, a succession button 23 and a termination button 24 for giving instructions how to cope with fueling after the oil-feeding operation suspended by a seismic perception.

Figure 3:
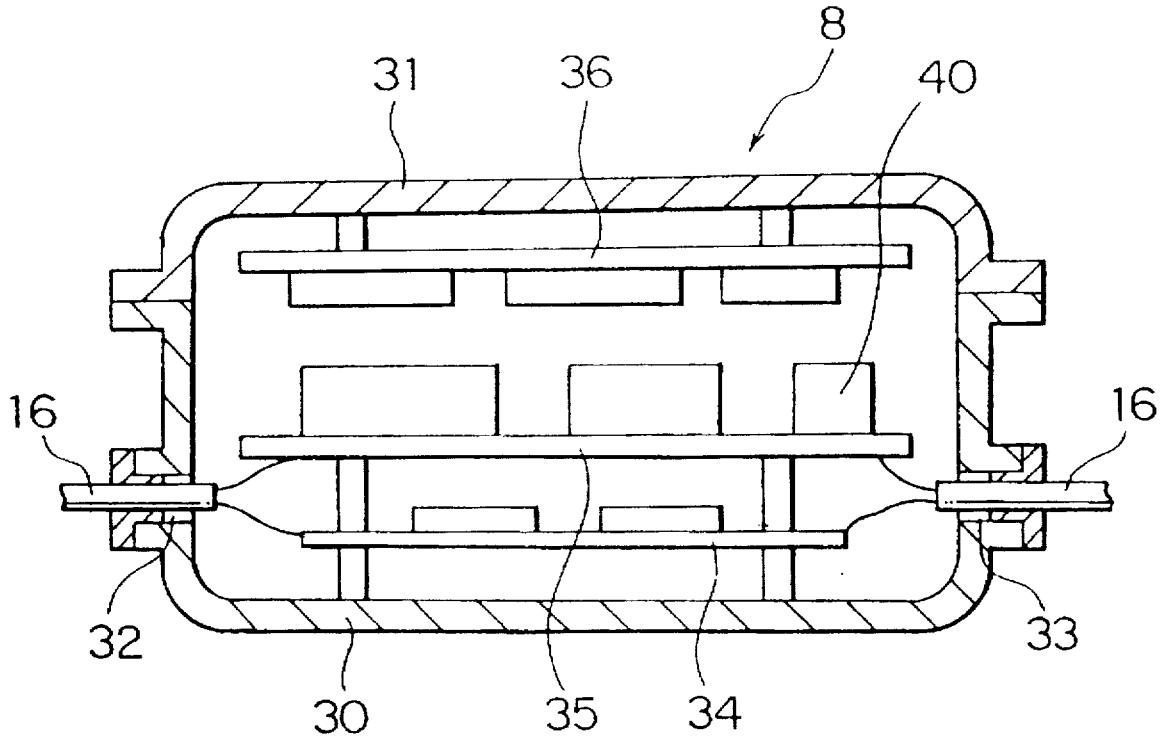
FIG. 3 is a diagram for showing an embodiment of fueling control means contained in the above fuel dispenser in FIG. 1.

FIG. 3 shows an embodiment of the aforementioned control means 8, wherein reference numerals 30 and 31 respectively indicate a casing main body and a cover constituting e.g. a pressure-resistant explosion-proof casing. There are through-holes 32 and 33 penetratingly provided on the casing main body 30 at the both sides thereof to introduce the electric supply lines 16 therein, which are connected to the control means 8 as shown in FIG. 1, and circuit bases 34 and 35 are contained and fixed therein. Moreover, inside the cover 31, a circuit base 36 is contained and fixed, a seismoscope 40 is provided on one of the circuit bases 35.

Figure 4:
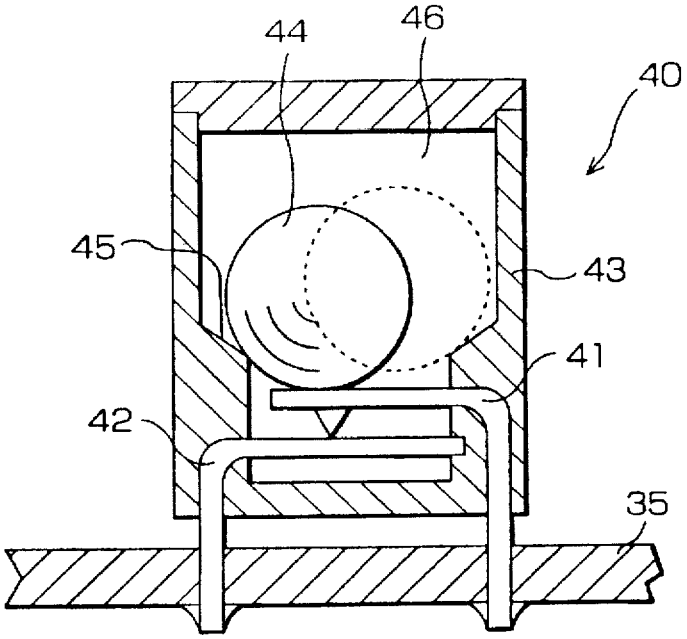
FIG. 4 is a vertical cross-sectional view of an embodiment of a seismoscope for use in the present invention.

FIG. 4 is a vertical cross-sectional view of an embodiment of a seismoscope for use in the present invention. There are provided in the seismoscope a movable electrode 41 which is prepared by an electroconductive blade spring, placed at an upper side, and a fixed electrode 42 which is placed lower side with respect to the movable electrode 41. Each of lower ends of the movable and fixed electrodes 41 and 42 are fixed in the circuit base 35, to have shape of a cantilever in such a fashion that a free end of the movable electrode 41 is bent and brought into contact with the fixed electrode 42. The movable electrode 41 is continually brought into elastic contact with the fixed electrode 42, and a spherical moving member 44 which is movable in the up and down directions, in this embodiment a steel sphere, is contained in a space 46 of the casing 43 to be arranged in a predetermined position under a guidance of taper part 45 formed at a lower part of the casing 43.

The above-mentioned taper part 45 formed at the lower part of the casing 43 becomes wider toward the upper part thereof. Thus, the spherical moving member 44 is brought into contact with a movable electrode 41 at a predetermined portion of the electrode 41, simultaneously the movable electrode 41 with continuously bringing into elastic contact with the fixed electrode 42. A taper angle is applied to the taper, by which the movable electrode 41 is separated from the fixed electrode 42 owing to the elasticity thereof when vibration in the horizontal direction is given, with the spherical moving member 44 gotten over the taper part 45 as shown by the broken line in FIG. 4.

Figure 5:
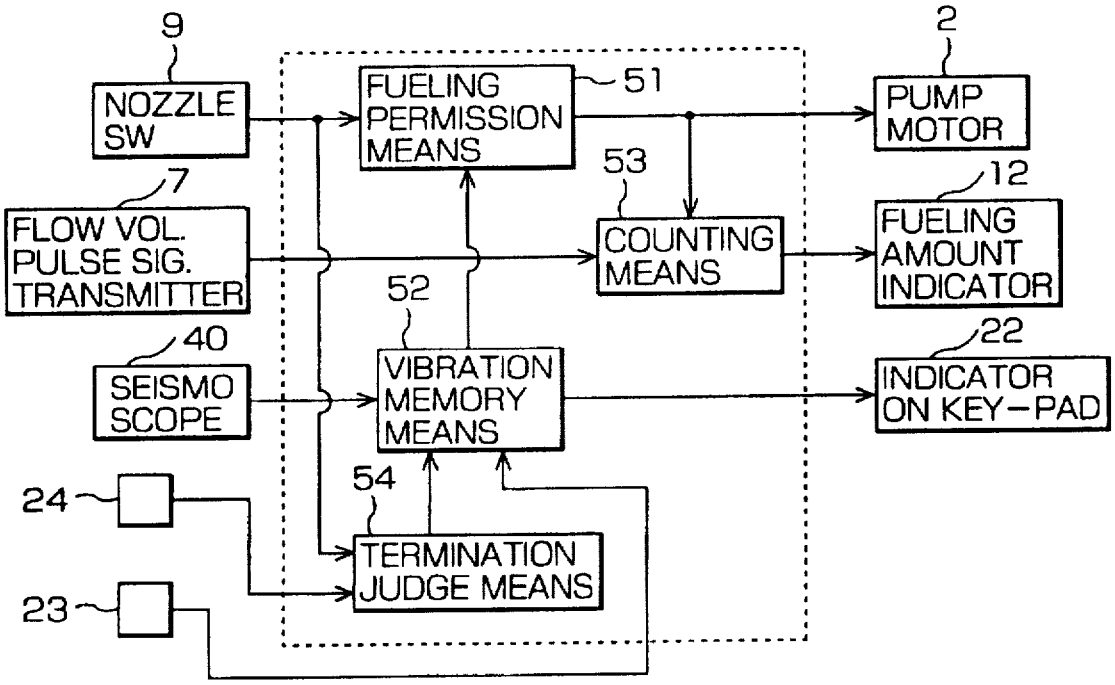
FIG. 5 is a block diagram for showing an embodiment of the above fueling control means.

FIG. 5 is a block diagram for showing the above-mentioned fueling control means 8. Fueling permission means 51 outputs a fueling permission signal to operate a pump motor 2 in accordance with the following steps:

When the fueling permission means receives a nozzle-unhooked signal from a nozzle switch 9, data stored in seismic vibration perception memory means 52, which will be explained later, is checked. If the perception signal is not stored therein, the fueling permission means 51 outputs fueling permission signal to operate the pump motor 2, and brings counting means 53 to zero. To the contrary, the oil-feeding means 51 does not output the fueling permission signal when the seismic perception signal is recorded in the seismic vibration perception memory means 52.

The seismic vibration perception memory means 52 receives and stores the seismic vibration perception signal output from a seismoscope 40, because of an earthquake or some other vibrations. Moreover, when a signal from termination judge means 54 which will be explained below is output, or when a fueling succession signal is input with the operation of the succession button 23 on the key pad 20, the seismic vibration perception memory means 52 deletes the memorized seismic vibration perception signal. Furthermore, the seismic vibration perception memory means 52 outputs the instruction to perform the vibration signal cancellation treatment to the indicator 22 on the key-pad 20 when a nozzle-unhooked signal is input in the state of seismic vibration perception being memorized. In this case the indicator 22 indicates the fueling interception thereon while the vibration perception signal is memorized in the memory means 52.

The termination judge means 54 outputs a signal to delete the seismic vibration perception signal restored in the seismic vibration perception memory means 52 when the termination button 24 on the key-pad 20 is operated in such a state that the nozzle-unhooked signal is being output.

Figure 6:
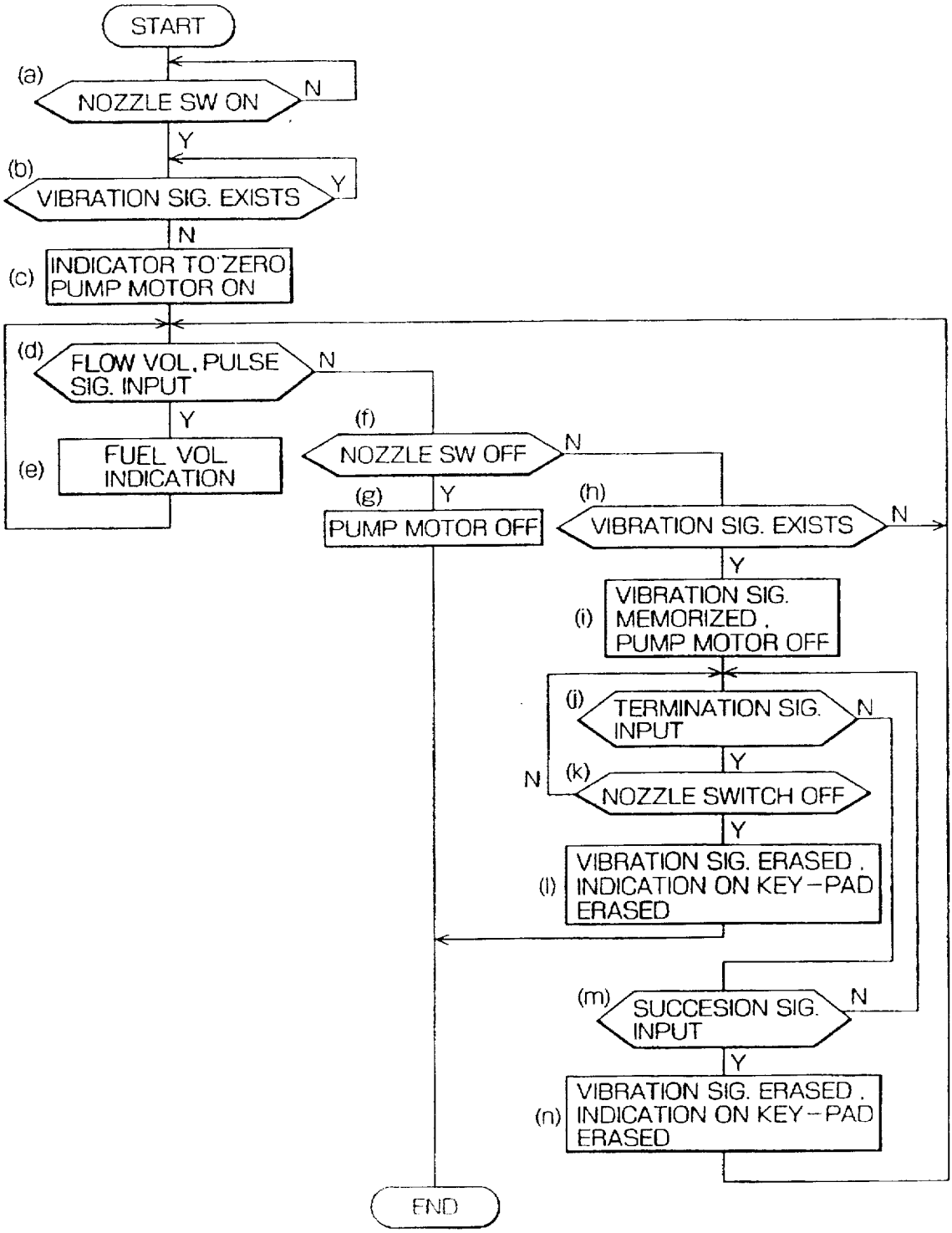
FIG. 6 is a flow-chart for explaining functions of the above control unit.

The functions of the fueling control means with the above explained structure will now be explained with referring to a flow-chart of FIG. 6.

When the nozzle 6 is unhooked from the nozzle rest 6 for fueling, the fueling permission means 51 outputs a fueling permission signal (step (a)), and the fueling permission means 51 judges whether a seismic vibration perception signal is stored in the seismic vibration memory means 52 (step (b)).

The fueling permission means 51 outputs the fueling permission signal, the fuel amount indicator 12 is brought to zero, and the pump motor 2 is turned on (step (c)), when the seismic vibration perception signal does not exist in the seismic vibration memory means 52. Thus, it becomes possible to perform fueling.

It becomes impossible to perform fueling, in the case where the seismic vibration perception signal is stored in the seismic vibration memory means 52, and the instructions to perform the seismic cancellation is indicated on the indicator 22 of the key-pad 20.

On the other hand, when flow volume pulse signals are output from a flow volume pulse signal transmitter 7 in accordance with fueling, the pulse signals are integrated, and indicated as fuel amount on the fuel amount indicator 12 (step (e)), as also shown in the block diagram of FIG. 5

While a nozzle-unhooked signal is output from a nozzle switch 9 (step (f)) by fueling, the presence or absence of the seismic vibration perception signal from the seismoscope 40 is detected (step (h)).

In the case where the seismic vibration perception signal from the seismoscope 40 is not output, fueling is completed without any problems, the main valve is closed, the transmission of the flow amount pulse signal is stopped (step (d)), the nozzle 6 is brought back to the nozzle rest 15, and then a nozzle-hooked signal is output (step (f)), the fueling permission means 51 turns off the pump motor 2 with electrical supply to the pump motor 2 cut off (step (g)).

On the other hand, when the seismic vibration perception signal is output from the seismoscope 40 with the perception of vibration such as earthquake (step (h)), the seismic vibration perception memory means 52 memorizes the perception signal, outputs a signal for conveying the storage of the seismic vibration perception signal to the fueling permission means 51, whereby the pump motor 2 is turned off. Subsequently, information of the fueling suspension is indicated on indicator 22 of the key-pad 20 by the detection of the seismic vibration perception signal (step (i)).

The nozzle 6 is brought back to a nozzle rest 15 as an immediate measure if there is the risk that the seismic vibration perception signal is based on an earthquake or the like, which may adversely affect on the fuel dispenser.

Then, the fueling termination treatment is carried out by operating the termination button 24 on the key-pad 20. According to this, the termination signal is output (step (j)), the nozzle 6 is brought back to the nozzle rest 15, thereby the nozzle-hooked signal is out put from the nozzle switch 9 (step (k)). Thereafter, the termination judge means 54 deletes the seismic vibration perception signal stored in the seismic vibration perception memory means 52, and erases the indication on the indicator 22 of the key-pad 20.

If the nozzle 6 has not been brought back to the nozzle rest 15 until the termination button 24 is operated (step (k)), the seismic vibration perception signal is deleted and the indication on the indicator 12 is erased as explained above (step (l)) after the nozzle-hooked signal is output from the nozzle switch 9 with the nozzle 6 brought back to the nozzle rest 15.

When the seismic vibration perception signal is output during the fueling (step (h)), and the vibration is so small that it is unnecessary to bring the nozzle 6 back to the nozzle rest 15, the succession button 23 on the key-pad 20 is operated.

By the operation of the succession button 23, the succession signal is output (step (m)). Then, the seismic vibration perception memory means 52 deletes the seismic perception signal stored therein, and causes the pump motor 2 in the suspension state to start again, without the fed oil amount indication before the suspension bringing to zero. In this case the memory means 52 erases the indication on the key-pad 20 (step (n)).

Accordingly, the fueling is started again. By the flow volume pulse signal input by the flow volume pulse transmitter 7 (step (d)), the fuel volume fed after the suspension is added to the fuel volume fed before the suspension, and the total volume is indicated on the fuel amount indicator 12 (step (e)).

As can been seen from the above explanation, it is possible not only to perform the treatment of seismic perception cancellation by a simple operation of pressing the button on the key-pad 20 in regard to a slight vibration, but also to perform the counting operation in succession to the previous fueling without cancellation of the fueling amount indication immediately before the fueling suspension when the fuel dispenser of this embodiment is employed.

In this embodiment, the treatment after the fueling suspension accompanied with the seismic vibration perception is carried out by using the key-pad provided in the fuel dispenser main body. Alternatively, it is obvious to be able to obtain the same effect with the same treatment performed when POS positioned at an office is employed.

The present invention provides the other three types of fuel dispensers with partial modifications applied thereto.

More precisely, each of the modified fuel dispensers comprises therein a control unit for causing the pump motor to be "on" and "off" by receiving the nozzle-unhooked signal and the nozzle-hooked signal respectively, and counting the flow volume of fuel by receiving the flow volume pulse signal from the flow volume measuring means, and a vibration perceptive electric supply interception unit.

The three types of fuel dispensers have different vibration perceptive electric supply interception unit from each other.

The first modification of the fuel dispenser has a vibration perceptive electric supply interception unit comprising a magnetic memory relay composed of a set coil, reset coil, and first and second magnetic memory contacts which magnetically maintain an "on" state when at least the set coil is excited, an "off" state when only the reset coil is excited, and the "on" state when the set coil and the reset coil are simultaneously de-energized, a vibration response switch by which the contacts are caused to be "off" when vibration is perceived, an electric relay consisting essentially of an operation coil, and first and second electric relay contacts for intercepting electric supply, a reset switch, electric supply lines, and a casing for containing the magnetic memory relay, vibration response switch, electric relay, and reset switch therein; the set coil connected to the first magnetic memory contacts and the vibration response switch in series to prepare a first series circuit, the reset coil connected to the second magnetic memory contacts and the operation coil to prepare a second series circuit, each of the first and second series circuits connected in parallel to the electric supply lines, and the reset switch connected in parallel to the first magnetic memory contacts, thereby electricity to be supplied to the fuel dispenser by way of the electric relay contacts.

Figure 7:
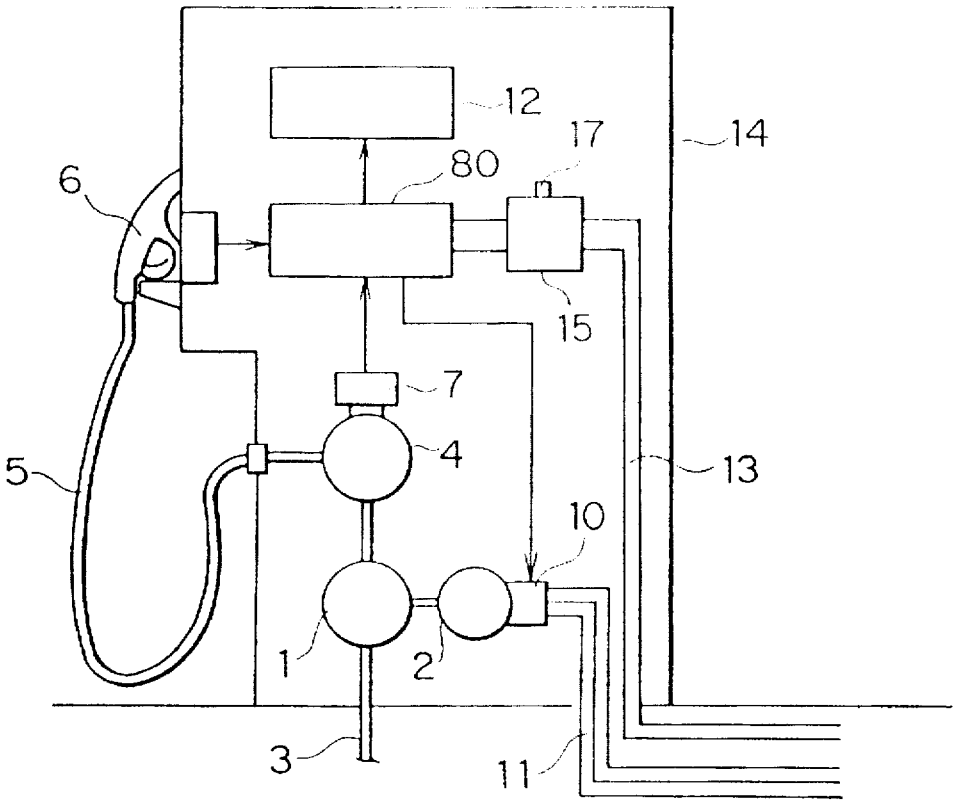
FIG. 7 is a diagram for showing an embodiment of a fuel dispenser with an electric supply interception unit of the present invention.

FIG. 7 is a diagram for showing an embodiment of the above fuel dispenser comprising an electric supply interception unit according to the present invention. Each of reference numerals in FIG. 7 has the same meaning as in FIG. 1 with the same function thereof, although a vibration perceptive electric supply interception unit 15 with an operation button 17 is contained in the casing 14, which is the fuel dispenser main body, being connected to a control unit 80 via electric supply lines 13 for supplying electricity to drive the control unit 8, and does not contain the key pad 20 in the embodiment shown in FIG. 7.

Figure 8:
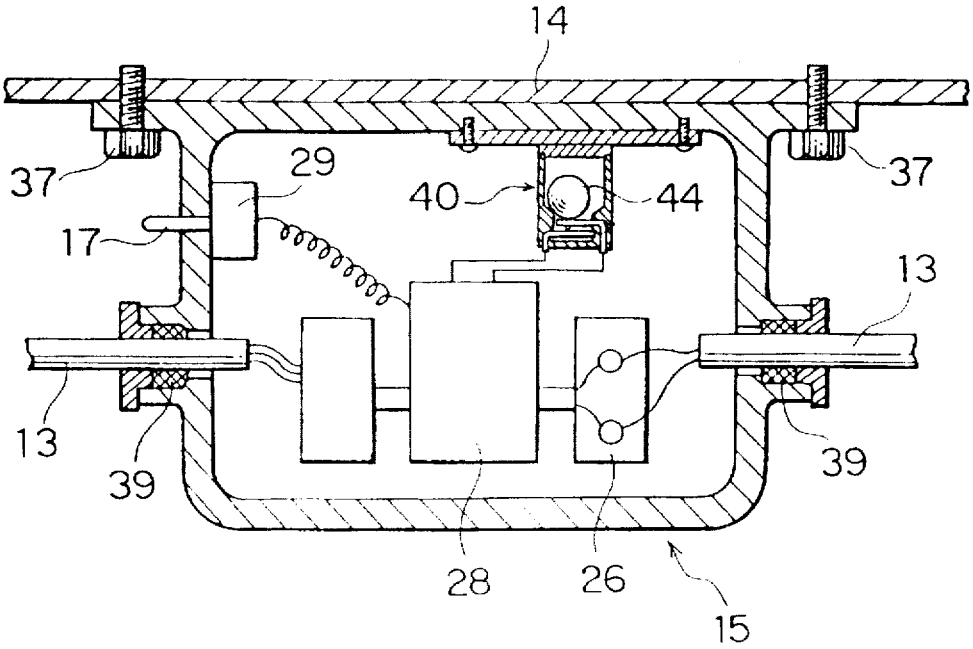
FIG. 8 is a vertical cross-sectional view for showing an embodiment of an internal structure of the above electric supply interception unit.

FIG. 8 shows a vertical cross-sectional view of an embodiment of the above-mentioned electric supply interception unit.

The electric supply interception unit 15 for use in the present invention is designed as follows: A vibration response switch 25, connectors 26 and 27, a relay unit 28 which will be explained below, and a reset switch 29 are contained in a pressure resistant explosion-proof casing 38, which can be fixed to the casing 14 of the fuel dispenser main body by use of screws 37, and ends of electric supply lines 13 can be drawn into the casing 38 by way of packings 39.

The vibration response switch 25 designed as a switch which can change its state from on to off when detects vibration. In this embodiment, the same seismoscope 40 as in FIG. 4 is employed as the vibration response switch 25.

Figure 9:
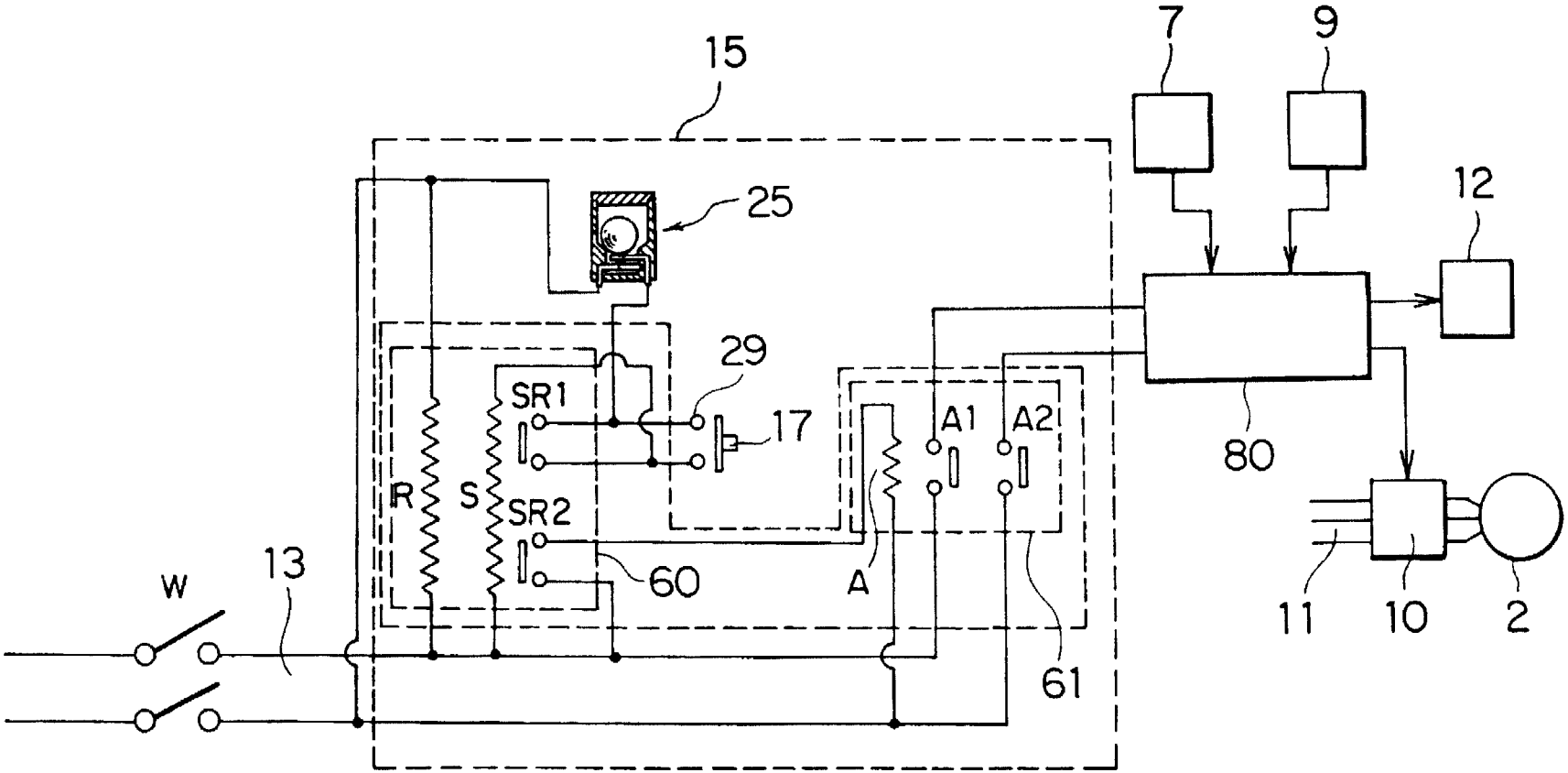
FIG. 9 is a diagram for showing the structure of the above electric supply interception unit.

FIG. 9 is a diagram for showing an embodiment of the structure of the seismic vibration perceptive electric supply interception unit 100.

A magnetic memory relay 60 as an essential constituent of a relay unit 70 comprises a set coil S, a reset coil R, first contacts SR1, second contacts SR2. Both of the contacts SR1 and SR2 have functions to magnetically maintain the previous state. The first and second contacts SR1 and SR2 magnetically memorize each state as follows:

The contacts assume "on" state changed from "off" state when at least the set coil S is excited.

The contacts assume "off" state when only the reset coil R is excited.

The contacts maintain "on" state when both the contacts are simultaneously de-energized.

The set coil S is connected in parallel with the electric supply lines 13, being connected in series to the first contacts SR1 and the vibration response switch 25, and the reset coil R is directly connected to the electric supply lines 13 in series. A normally opened reset switch 29 is connected the first contacts SR1 in series, and the second contacts SR2 is connected to the electric supply line 13 in series via an excitation coil A of an electricity relay 61. Further, a control unit 80 is connected to the electric supply lines 13 by way of contacts A1 and A2 of the electric supply relay 61 to receive electric supply for the operation.

When the electric supply interception unit 15 in this embodiment is employed, the reset switch 29 is caused to be "on" by use of an operation button 22 with main electricity supply switches W in an office turned on, so that the set coil S is excited by receiving electric supply from the electric supply lines 13 via a vibration response switch 25 and the reset switch 29. Accordingly, the first and second contacts SR1 and SR2 are preferentially caused to be "on", independent of the excitation of the reset coil R caused simultaneously with the main electric supply switches turned on.

Thus, the reset coil S maintains the "on" state, and the relay holds the self-held circuit, regardless the "on" or "off" state of the reset switch 29.

At the same time, the electric relay 61 is excited with the second contacts SR2 being on, whereby it becomes possible to perform fueling, under electricity supplied to the control unit 80 for the operation by way of these contacts A1 and A2.

When shock is applied to the casing 14 of the fuel dispenser in the above state because of an earthquake or a car crash, the vibration response switch 25 is changed its state from "on" to "off", and the set coil S is de-energized. Therefore, the excitation force of the reset coil R surpasses that of the set coil S, and the first and second contacts SR1 and SR2 assume the "off" state and maintain the "off" state thereafter.

Simultaneously, the electric relay 61 becomes "off", since the second contacts are "off". Therefore, the electric supply to the control unit 80 is cut off, whereby fueling is stopped with the motor control switch 10 turned off.

The main electric supply switches W are turned off for safety confirmation, and turned on when it is confirmed that there is nothing unusual.

In this state, both the first and the second contacts SR1 and SR2 are off, so that only the reset coil R is excited and the contacts SR1 and SR2 still maintain the "off" state.

Accordingly, the suspension state can be maintained without supplying electricity to the control unit 80 of this fuel dispenser of the present invention, even when electricity is accidentally supplied, or when the electric supply is started again after the electrical breakdown because of an earthquake is restored.

If the reset switch 29 is pressed in the state that electricity is being fed, the set coil S is excited as mentioned previously, so that the contacts SR1 and SR2 are caused to be "on" independent of the excitation or non-excitation state of the reset coil R. Thus, the contacts A1 and A2 in the electricity relay 61 comes to "on", and consequently the electricity is supplied to the control unit 80 to perform fueling.

When the main electric supply switches W are turned off at the end of a daily work, the contacts SR1 and SR2 magnetically maintain the state before the electric interception, that is, the "on" state, since the set coil S and the reset coil R are simultaneously de-energized.

The contacts SR1 and SR2 maintain the "on" state without changed from the previous state, when the main electric supply switches W are turned on for starting a daily business. This is because the set coil S is excited together with the reset coil R by way of the first contact SR1 which memorizes the "on" state. As a result, in this case, the electric relay 61 comes to "on" by way of the second contact SR2, without operating the reset switch 29, thereby oil feeding can be performed.

In the above described embodiment, electricity is supplied to the control unit 80 or the electric supply is intercepted by the function of the vibration response switch 25. Alternatively, it is obvious that the same effect can be obtained when the electric interception is directly performed by the control unit 80 provided via a power line 11.

Consequently, with the provision of the electric supply interception unit, it is possible to prevent an accidental electric supply until the safety is confirmed when the electrical breakdown caused by an earthquake is resumed.

The second modification of the fuel dispenser contains therein a vibration perceptive electric supply interception unit comprises a first relay comprising a first normally closed contacts IA, first normally opened contacts IB, and second normally opened contacts IC, a second relay comprising first normally opened contacts IIA, second normally opened contacts IIB, and third normally opened contacts IIC, and a vibration response switch by which the contacts are caused to be "off" when vibration is perceived, electricity supplied to the fuel dispenser by way of the second normally opened contacts IC of the first relay and the third normally opened contacts IIC of the second electric relay when the second relay is energized by way of the normally closed contacts IA and the vibration response switch.

The third modification of the fuel dispenser comprises a vibration perceptive electric supply interception unit comprising a first relay comprising first normally closed contacts IA, first normally opened contacts IB, and second normally opened contacts IC, a second relay comprising first normally opened contacts IIA, second normally opened contacts IIB, and third normally opened contacts IIC, a vibration response switch by which the contacts are caused to be "off" when vibration is perceived, and electric supply lines, the first relay connected to the electric supply lines by way of the first normally opened contacts IB of the first relay and the first normally opened contacts IIA of the second relay, and the second relay connected to the electric supply lines by way of the normally closed contacts IA and the second normally opened contacts IIB of the second relay with the second relay being connected to the vibration response switch in series, thereby electricity being supplied to the fuel dispenser by way of the second normally opened contacts IIB of the second relay and the second normally opened contacts IC of the first relay, or the third normally opened contacts IIC of the second relay.

The embodiment of the above fuel dispensers of the present invention can be illustrated as in FIG. 7, although the operation button 17 is not provided in this case.

The seismic vibration perceptive electric supply interception unit 18 for use in this embodiment, which corresponds to the reference numeral 15 in FIG. 7, is connected to electric supply lines for supplying electricity for driving the control unit 80. The interception unit 18 is essentially composed of a first relay I, a second relay II, and a vibration response switch 25 as shown in FIG. 10.

The first relay I comprises normally closed contacts IA, and first and second normally opened contacts IB and IC, and the second relay II comprises first, second and third normally opened contacts IIA, IIB and IIC. The vibration response switch 25 has the same structure and function as previously explained in FIG. 4.

Figure 10:
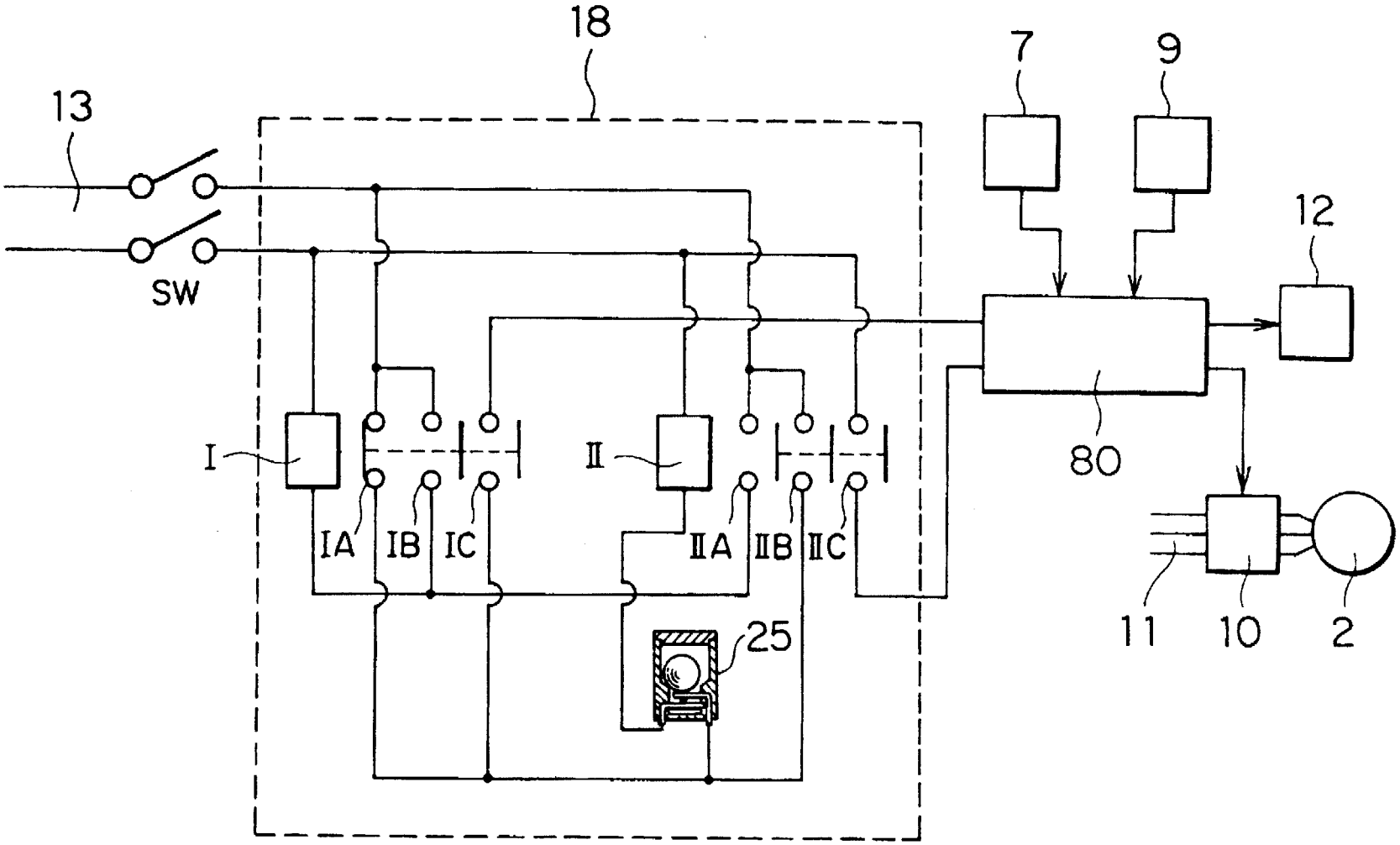
FIG. 10 is a diagram for showing the structure of an embodiment of an electric supply interception unit for use in the present invention when main switches are "off"

As is obvious from FIG. 10, the first relay I is connected to electric supply lines 13 through the first normally opened contacts IB and the first normally opened contacts IIA of the second relay II, that can be self-held even after the circuit is started to be driven. The second relay II is connected in series to the vibration response switch 25, and further connected to the electric supply lines 13 by way of two systems passing through the normally closed contact IA of the first relay I, or the normally opened contacts IIB of the second relay II. The control unit 80 is connected to the electric supply lines 13 via the second normally opened contacts IC of the first relay I, the second normally opened contacts IIB of the second relay II, and the third normally opened contacts IIC of the relay II.

In this embodiment, when the main switches are turned on, provided at a place such as an office, the relay II is started to function by way of the normally closed contacts IA of the first relay I and the vibration response switch 25, followed by closing all the contacts IIA, IIB and IIC of the second relay II.

The normally closed contacts IA is opened with the application of electricity to the first relay I passing through the contact IIA when the second relay II is energized. The relay I, in this case, can maintain the self-held state by way of the contact IB. At the same time, the second relay II maintains the self-held state with electricity supplied from the electric supply line 13 through the normally opened contacts IIB.

Figure 11:
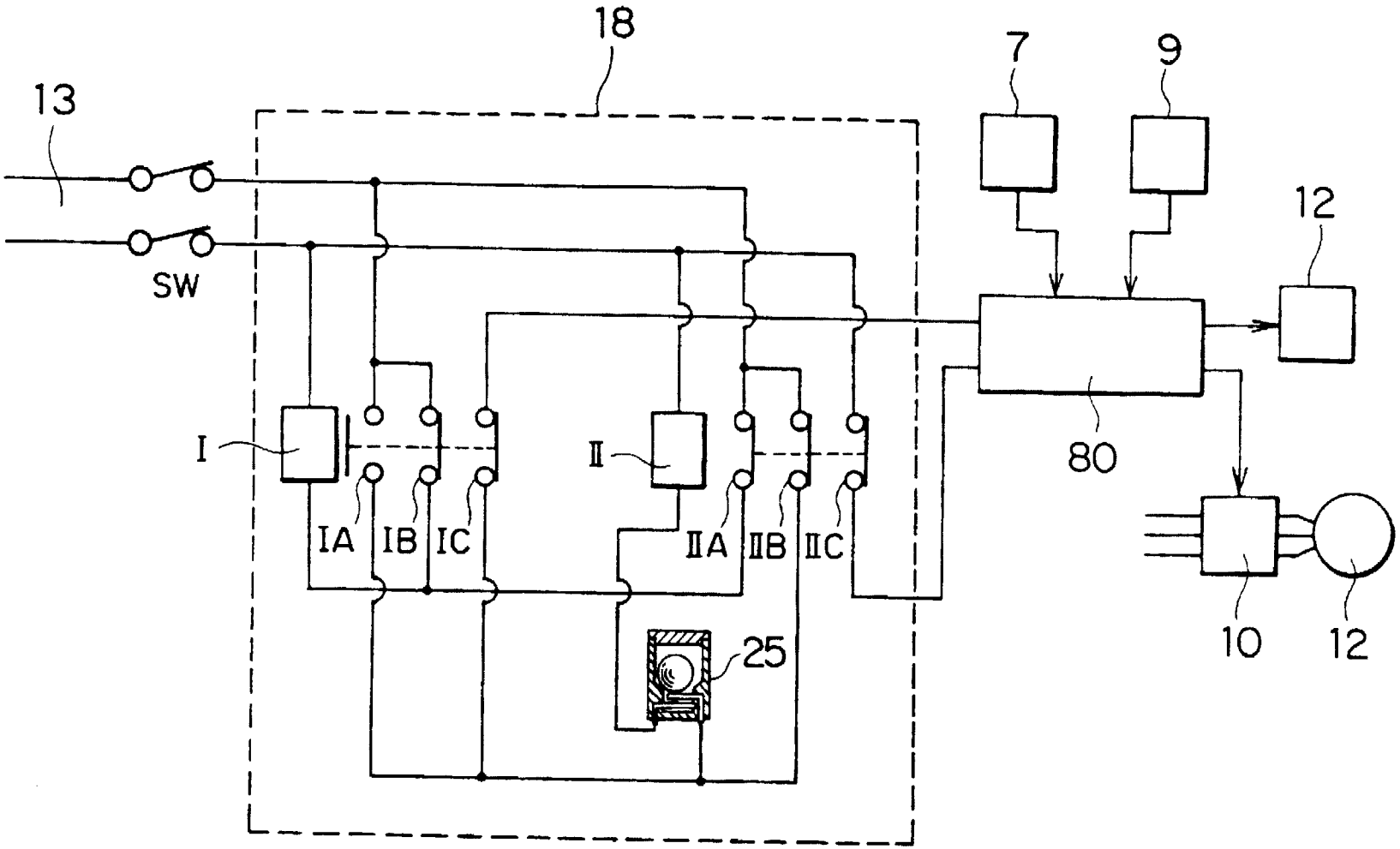
FIG. 11 is a diagram for showing the structure of the same electric supply interception unit as in FIG. 10 when fueling is normally performed with the main switches "on"

Thus, electricity is supplied from the electric lines 13 to the control unit 80 through the contact IIC of the second relay II, or through the contact IC of the first relay I and the contact IIB of the second relay, that is illustrated in FIG. 11 as a diagram of an embodiment of the electric supply interception unit when the unit normally functions with the main switches "on".

To the contrary, when the vibration response switch is turned off with the movable electrode 41 separated from the fixed electrode 42 owing to an earthquake or a car crash, the second relay II is de-energized and all the contacts IIA, IIB and IIC thereof are opened. On the other hand, the first relay I holds the energized state under the application of electricity thereto through the contact IB, thereby the contact IA is maintained open.

Figure 12:
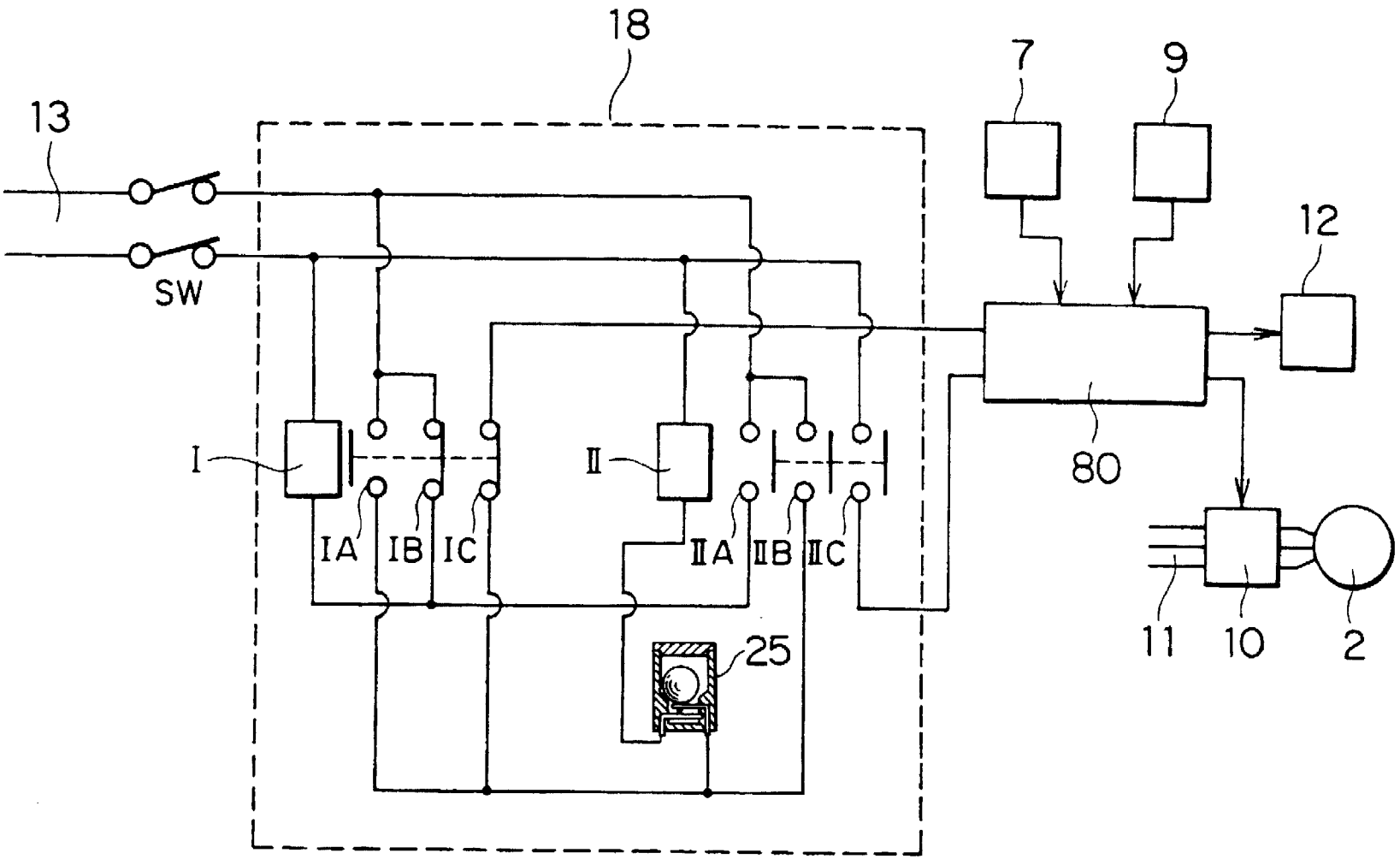
FIG. 12 is a diagram for showing the structure of the same electric supply interception unit as in FIG. 10 when a seismic vibration is perceived with the main switches "on".

In this state, regardless of the "on" or "off" state of the vibration response switch 25, the second relay II is not energized and the contact IIC is maintained to be opened, so that the electric supply to the control unit 8 is intercepted. This state is shown in the diagram of FIG. 12 of the electric supply interception unit 18.

It is a matter of course that the electric supply to the control unit 8 becomes impossible irrespective of the "on" or "off" state of the relays I and II when the commercial electric supply is cut off by an earthquake or some other reasons, with the first relay I turned off and the contacts IA closed.

When the main switches SW are turned off and then turned on again after safety confirmation, the second relay II is caused to be "on" by way of the normally closed contact IA of the first relay I as described above, followed by the above mentioned steps, whereby electricity is supplied to the control unit 80.

In the electric supply interception unit described in the above embodiment in the present invention, the fueling mechanism can be maintained in the nonperformance state until the electric supply is started again even when the relays are damaged because of vibration such as an earthquake. This is because the normally closed contact of the first relay can be maintained open.

What is claimed is:

1. A fuel dispenser with a seismic vibration perception function comprising:

a pump motor;

a fuel-feeding pump which is driven by said pump motor;

flow volume measuring means for measuring the amount of fed fuel and outputting a flow volume pulse signal;

a nozzle switch for transmitting a nozzle-unhooked signal and a nozzle-hooked signal; and fueling control means for causing said pump motor to be "on" and "off" by receiving said nozzle-unhooked signal and said nozzle-hooked signal respectively, and counting the flow volume of fuel by receiving said flow volume pulse signal, said fueling control means comprising seismic vibration perception means for perceiving vibration and transmitting a seismic vibration perception signal for suspending electric supply to said pump motor.

2. The fuel dispenser with a seismic vibration perception function as claimed in claim 1, wherein said fueling control means starts to fuel again by receiving a succession signal from outside said control means, with the amount indication of fuel fed after the fueling suspension being integrated with the amount indication of fuel fed before the suspension, when fueling is suspended in accordance with said seismic vibration perception signal and said nozzle-unhooked signal is being output.

3. The fuel dispenser with a seismic vibration perception function as claimed in claim 1, wherein said fueling control means accepts a termination signal to terminate fueling, when fueling is suspended in accordance with said seismic vibration perception signal and said nozzle-hooked signal is being output.

4. The fuel dispenser with a seismic vibration perception function as claimed in claim 2, further comprising a seismic vibration perception memory means for memorizing said seismic vibration perception signal and erasing the same in accordance with said succession signal, and an indicator for indicating the fueling interception based on seismic vibration perception while said seismic vibration perception signal is memorized.

5. The fuel dispenser with a seismic vibration perception function as claimed in claim 3, further comprising a seismic vibration perception memory means for memorizing said seismic vibration perception signal and erasing the same in accordance with said termination signal, and an indicator for indicating the fueling interception based on seismic vibration perception while said seismic vibration perception signal is memorized.

6. A fuel dispenser with a seismic vibration perception function comprising:

a pump motor;

a fuel-feeding pump which is driven by means of said pump motor;

flow volume measuring means for measuring the amount of fed fuel and outputting a flow volume pulse signal;

a nozzle switch for transmitting a nozzle-unhooked signal and a nozzle-hooked signal;

a control unit for causing said pump motor to be "on" and "off" by receiving said nozzle-unhooked signal and said nozzle-hooked signal respectively, and counting the flow volume of fuel by receiving said flow volume pulse signal; and a vibration perceptive electric supply interception unit comprising a magnetic memory relay composed of a set coil, reset coil, and first and second magnetic memory contacts which magnetically maintain an "on" state when at least said set coil is excited, an "off" state when only said reset coil is excited, and said "on" state when said set coil and said reset coil are simultaneously de-energized; a vibration response switch by which said contacts are caused to be "off" when vibration is perceived; an electric relay consisting essentially of an operation coil, and first and second electric relay contacts for intercepting electric supply; a reset switch; electric supply lines; and a casing for containing said magnetic memory relay, vibration response switch, electric relay, and reset switch therein; said set coil connected to said first magnetic memory contacts and said vibration response switch in series to prepare a first series circuit, said reset coil connected to said second magnetic memory contacts and said operation coil to prepare a second series circuit, each of said first and second series circuits connected in parallel to said electric supply lines, and said reset switch connected in parallel to said first magnetic memory contacts, thereby electricity to be supplied to said fuel dispenser by way of said electric relay contacts.

7. The fuel dispenser with a seismic vibration perception function as claimed in claim 7, wherein said casing is made as a pressure resistant explosion-proof box, and said reset switch can be operated from the outside.

8. A fuel dispenser with a seismic vibration perception function comprising:

a pump motor;

a fuel-feeding pump which is driven by means of said pump motor;

flow volume measuring means for measuring the amount of fed fuel and outputting a flow volume pulse signal;

a nozzle switch for transmitting a nozzle-unhooked signal and a nozzle-hooked signal;

a control unit for causing said pump motor to be "on" and "off" by receiving said nozzle-unhooked signal and said nozzle-hooked signal respectively, and counting the flow volume of fuel by receiving said flow volume pulse signal; and a vibration perceptive electric supply interception unit comprising a first relay comprising first relay first normally closed contacts, first relay first normally opened contacts, and first relay second normally opened contacts; a second relay comprising second relay first normally opened contacts, second relay second normally opened contacts, and second relay third normally opened contacts; and a vibration response switch by which said contacts are caused to be "off" when vibration is perceived, electricity supplied to said fuel dispenser by way of said first relay second normally opened contacts and said second relay third normally opened contacts when said second relay is energized by way of said first relay first normally closed contacts and said vibration response switch.

9. A fuel dispenser with a seismic vibration perception function comprising:

a pump motor;

a fuel-feeding pump which is driven by means of said pump motor;

flow volume measuring means for measuring the amount of fed fuel and outputting a flow volume pulse signal;

a nozzle switch for transmitting a nozzle-unhooked signal and a nozzle-hooked signal;

a control unit for causing said pump motor to be "on" and "off" by receiving said nozzle-unhooked signal and said nozzle-hooked signal respectively, and counting the flow volume of fuel by receiving said flow volume pulse signal; and a vibration perceptive electric supply interception unit comprising a first relay comprising first relay first normally closed contacts, first relay first normally opened contacts, and first relay second normally opened contacts; a second relay comprising second relay first normally opened contacts, second relay second normally opened contacts, and second relay third normally opened contacts; a vibration response switch by which said contacts are caused to be "off" when vibration is perceived; and electric supply lines; said first relay connected to said electric supply lines by way of said first relay first normally opened contacts and said second relay first normally opened contacts, and said second relay connected to said electric supply lines by way of said first relay normally closed contacts and said second relay second normally opened contacts with said second relay being connected to said vibration response switch in series, electricity to be supplied to said fuel dispenser by way of said second relay second normally opened contacts and said first relay second normally opened contacts, and said second relay third normally opened contacts.

10. The fuel dispenser with a seismic vibration perception function as claimed in claim 9, wherein said second relay is connected to said electric supply lines by way of said second relay second normally opened contacts and said vibration response switch.

* * * * *